United States Patent [19]

Gran

[11] 4,314,464

[45] Feb. 9, 1982

[54] WET TREATMENT OF TEXTILES

[76] Inventor: Staffan O. Gran, Baldersplatsen 7, Boras-Schweden, Sweden

[21] Appl. No.: 29,672

[22] Filed: Apr. 11, 1979

[30] Foreign Application Priority Data

Apr. 18, 1978 [DE] Fed. Rep. of Germany ..... 2816808

[51] Int. Cl.[3] ..... D06B 3/28

[52] U.S. Cl. ..... 68/178

[58] Field of Search ..... 68/177, 178

[56] References Cited

U.S. PATENT DOCUMENTS

| | | | |
|---|---|---|---|
| 1,778,380 | 10/1930 | Conrad | 68/178 X |
| 3,016,728 | 1/1962 | Mann et al. | 68/178 X |
| 3,402,410 | 9/1968 | Schumm et al. | 68/178 X |
| 3,411,328 | 11/1968 | Fleissner | 68/178 X |
| 3,952,558 | 4/1976 | Sandberg et al. | 68/177 |
| 4,036,038 | 7/1977 | Aurich et al. | 68/178 X |

FOREIGN PATENT DOCUMENTS

| | | | |
|---|---|---|---|
| 2714801 | 12/1977 | Fed. Rep. of Germany | 68/177 |

*Primary Examiner*—Philip R. Coe

[57] ABSTRACT

A device for the wet treatment of textiles in endless strip or web form, including a housing, at least one bow-shaped, partially perforated and/or slotted supply chamber in the housing, at least one inlet arranged at an elevated position on the housing, and at least one outlet arranged at the lowest point of the housing for circulating wet treatment means through the device and wherein the supply chamber has a substantially rectilinear portion adjacent the outlet, the longitudinal axis of which is inclined at between 30° and 60° to the horizontal. There is further contemplated a layer of plastic material for providing a sliding surface, located within the supply chamber adjacent the outlet for the wet treatment means, and at least on the radially outer wall of the supply chamber, the layer extending over the whole width of the supply chamber.

10 Claims, 1 Drawing Figure

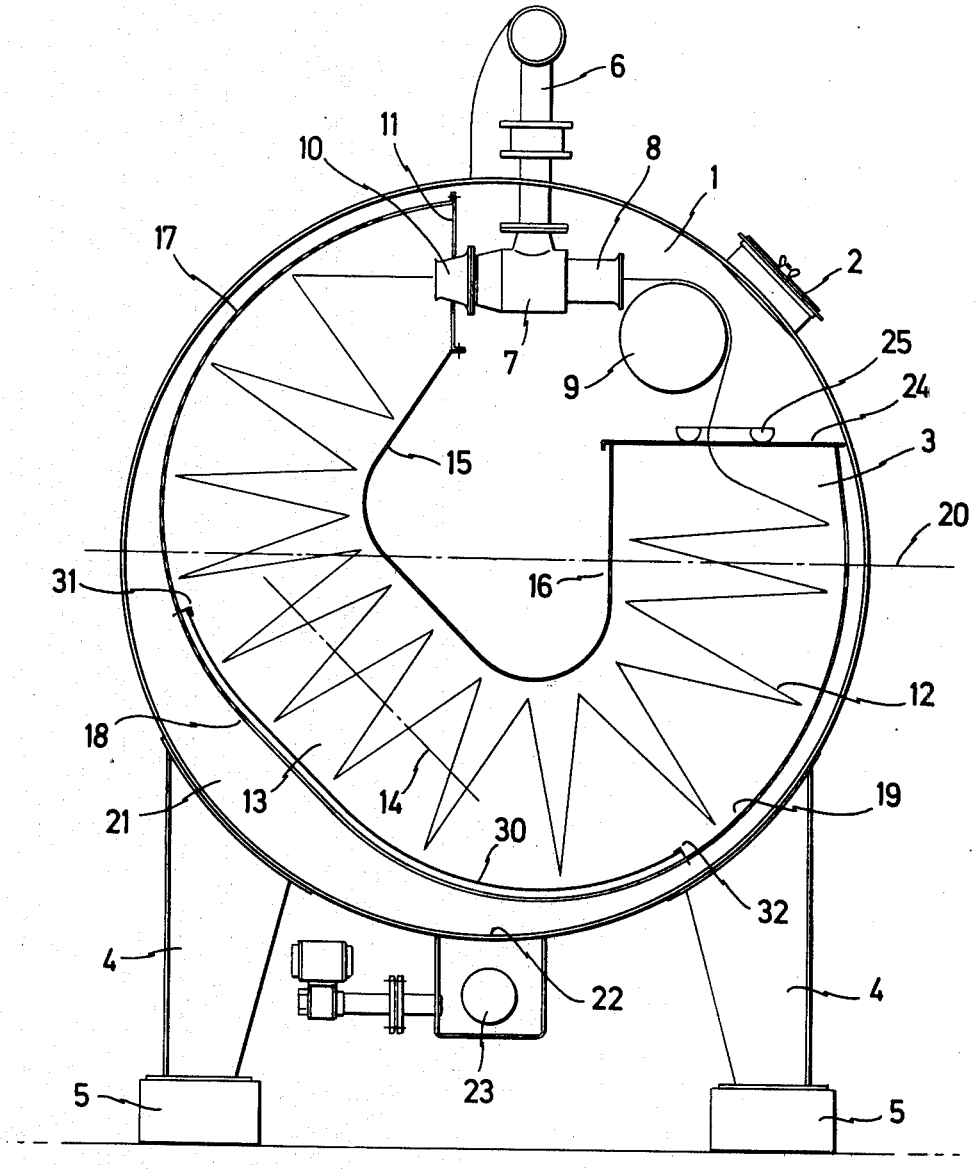
6
11
10
8
1
17
2
7
25
9
24
3
15
20
31
16
12
18
13
14
19
21
30
32
4
22
4
23
5
5

WET TREATMENT OF TEXTILES

BACKGROUND OF THE INVENTION

The present invention relates to a device for the wet treatment of textiles in endless strip or web form.

West German Pat. No. 2,424,438 describes a device comprising at least one bow-shaped, partially perforated and/or slotted supply chamber, at least one inlet arranged at the highest point of the device, and at least one outlet arranged at the lowest point of the device, for the circulating wet treatment means. This known device has a supply chamber the perforated outside of which is shaped to the curvature of the cylindrical pressure chamber; this chamber is connected, in its upper region, through an inlet/outlet with an impeller nozzle, so that the textile material can be piled in the supply chamber when it leaves the impeller nozzle, and is fed further therein.

While the impeller nozzle can be used for various types of textiles, with a particular textile material to be subjected to wet treatment, such as plush or terry, the inside surface of the supply chamber so impedes the textile material by friction that the circulation speed of the textile material caused by the impeller nozzle must be increased or intensified. This would also be the case if for example the pressure chamber were half-filled with a wet treatment means.

An object of the invention is to provide and improved device for the wet treatment of textiles.

Also known from DE-OS 2, 143,695 is a bow-shaped housing for the wet treatment of textiles, which housing has several rectilinear sections for feeding the textile material which is being circulated and is capable of being piled; these rectilinear sections, however, run horizontally or substantially vertically in the region of the outlet for the wet treatment means. A reduction of the friction forces within the supply chamber is, however, not achieved by these known rectilinear sections.

SUMMARY OF THE INVENTION

The present invention provides a device for the wet treatment of textiles in endless strip or web form, comprising a housing, at least one bow-shaped, partially perforated and/or slotted supply chamber in said housing, at least one inlet arranged at an elevated position on the housing, and at least one outlet arranged at the lowest point of the housing for circulating wet treatment means through the device and wherein the supply chamber has a substantially rectilinear portion adjacent the outlet, the longitudinal axis of which is inclined at between 30° and 60° to the horizontal.

In accordance with an especially preferred embodiment of the present invention, the rectilinear region is formed substantially perforation- or slot-free; in this way not only is an especially good removal of the piled textile material achieved in this region, but also, as is further set out in more detail below, an increase in the pump output is obtained.

The rectilinear region conveniently extends over the whole width of the supply chamber.

The present invention also provides a device for the wet treatment of textiles in endless strip or web form, comprising a housing, at least one bow-shaped, partially perforated and/or slotted supply chamber in said housing, at least one inlet arranged at an elevated position on said housing, and at least one outlet arranged at the lowest point of the housing for circulating wet treatment means through the housing, and wherein a layer of plastics material for providing a sliding surface is located within the supply chamber adjacent the outlet for the wet treatment means, and at least on the radially outer wall of the supply chamber, said layer extending over the whole width of the supply chamber.

The layer of plastics material can also be provided, however, in devices which have bow-shaped supply chambers of different shape.

The layer of plastics material preferably consists of polytetrafluoroethylene; it can be laid loosely and removably on the supply chamber and be secured thereto at least at its edge facing the inlet for the wet treatment means.

It is further possible that the supply chamber has an approximately rectilinear region and is provided with a removable layer of plastics material providing a sliding surface; thus, both the different resolving proposals for the inventive device on the inside of the supply chamber can be combined.

In this connection it is to be pointed out that of course the polished stainless steel surface usually used in the known supply chambers produces a certain reduction in the friction, so that the frictions arising in a wet treatment, e.g. in dyeing cotton, are reduced to a certain degree; however in using the polished stainless steel surfaces difficulties arise insofar as this surface is affected by dyestuffs or other chemicals which have to be added to the wet treatment means. It is also known to reduce the friction in the supply chamber by adding certain chemical materials to the wet treatment means; however, this known solution has the disadvantage that thereby the dye itself is affected detrimentally, because a considerable foaming can arise or indeed stains can be formed.

These disadvantages are reduced by the use of the above-mentioned layer of plastics material.

It is further possible for the supply chamber to be accommodated in a bow-shaped housing or in a cylindrical pressure chamber. The invention thus facilitates its use with different types of wet treatment devices, especially jet dyeing machines.

In order to control the circulation of the textile material in the supply chamber to the greatest possible extent, provision can be made, when a horizontally arranged impeller nozzle is provided in the upper region of the cylindrical pressure chamber, for the outlet end of the impeller nozzle to project into the supply chamber, which is provided with a vertically extending inlet edge, and the supply chamber to have an outlet edge arranged horizontally beneath a feed roll.

BRIEF DESCRIPTION OF THE DRAWING

The present invention is further described hereinafter, by way of example, with reference to the accompanying drawing.

DESCRIPTION OF THE PREFERRED EMBODIMENT

As well as the possibility for use of the invention (not shown) in a bow-shaped housing, the drawing shows a cylindrically formed pressure chamber 1 (the pressure chamber 1 may alternatively be bow-shaped) which contains at least two, at most three to five, devices of like type, arranged adjacent one another normally to the plane of the drawing. A supply chamber 3 is provided in the pressure chamber 1, which is provided with a cover 2 which can be screwed on.

The pressure chamber 1 rests on feet 4 on bases 5.

At the highest point of the pressure chamber 1 an inlet tube 6 is inserted into the pressure chamber, said tube leading to a horizontally arranged impeller nozzle 7. A free-running or driven, as desired, feed roll 9 is arranged in front of an inlet tube 8 of the drive nozzle 7. An outlet end 10 of the impeller nozzle 7 is relatively short and projects into the supply chamber 3 whose inlet edge 11 lies in a substantially vertical plane and is arranged immediately in the vicinity of the impeller nozzle. The impeller nozzle is conveniently formed as a Venturi tube and guides both strip-form textile material 12, which circulates around the chamber 3 and also the treatment fluid, for example a dye introduced through the inlet 6.

The supply chamber 3 has an asymmetric bow-shape, a portion 13 of which runs in a straight line; the longitudinal axis 14 of this rectilinear portion forms an angle of about 45° with the horizontal.

This rectilinearly formed portion has been proved, from scientifically conducted experiments, to be especially suitable for the reduction of the friction losses.

A wall 15 of the supply chamber 3 facing the center of the pressure chamber 1 is unperforated from adjacent the nozzle 7 up to the region 16. The supply chamber 3 is provided with perforations in the wall region 17 facing the impeller nozzle; these perforations extend, however, only to a region 18. From this region to the region 19 the supply chamber has no perforations; the latter beginning again at the region 19 and extending up to the surface 20 of the wet treatment means provided.

The unperforated wall of the supply chamber 3 between the regions 18 and 19 forms a wall of a space 21 in which the wet treatment means can "rest" and can flow away to an outlet area 22 in a substantially laminar manner. Because the wet treatment means flows away in this laminar manner, cavitation in a pump 23 can be avoided, so that the wet treatment means from this pump can be fed to the inlet 6 substantially in a laminar flow.

The supply chamber ends in a horizontal outlet edge 24 above which is arranged a ring 25 through which the textile material 12, lying in piles, can be gripped and unfolded.

Advantageously there is provided a layer 30 of plastics material providing a sliding surface. This can also be used in other types of machines for the wet treatment of textiles, but also additionally in the above-described jet dyeing machine. This layer of plastics material consists of e.g. 3 mm thick polytetrafluoroethylene, a material creating, as is well known, especially low friction, and extends approximately over an arcuate region of 90° to 100°; to prevent this sheet rolling up, a special heat treatment thereof can be provided.

The layer of plastics material is provided with one or more clamps 31 and can be secured accordingly in the perforations of the supply chamber 3. The layer of plastics material lies loosely on the radially outwardly lying side of the supply chamber and in addition can likewise be hung up at its end edge 32 in the supply chamber, if e.g. perforations are provided in this region.

This layer of plastics material especially impedes friction losses in the supply chamber, so that thereby the textile material can slide, practically without friction, from the region facing the impeller nozzle to that facing away from it. By reducing the friction the pressure for the impeller nozzle and thus the pressure of the pump 23 can be set lower, so that energy is saved. Since the work can be carried out with low nozzle pressure, the textile material can be treated substantially more gently, which is of important significance especially in dying pile fabrics, such as plush or terry.

I claim:

1. A device for the wet treatment of textiles in endless strip or web form, comprising a closed pressure housing having an interior wall for containing treatment liquid; an outlet located at the lowest point on said housing and opening through said housing interior wall; an inlet located at an elevated position on said housing and opening through said housing interior wall; means for externally circulating treatment liquid, connected between said outlet and said inlet; a supply chamber in said housing, said supply chamber having an outer wall spaced from said housing interior wall and having a first portion thereof perforated and a second portion thereof unperforated and rectilinear and a third portion thereof perforated, said second portion being intermediate said first and third portions and being positioned proximate said outlet, said second portion having a rectilinear axis inclined at from 30° to 60° to the horizontal; and means for circulating textiles through said supply chamber and for feeding treatment liquid into said supply chamber first portion, whereby said supply chamber second portion separates said textiles from treatment liquid circulation through said outlet.

2. A device according to claim 1, further comprising a removable layer of plastic material having a sliding surface, said layer being located at least primarily over the interior side of said supply chamber outer wall second portion.

3. A device for the wet treatment of textiles in endless strip or web form, comprising a closed pressure housing having interior walls for containing wet treatment material; a supply chamber in said housing, said supply chamber having an outside wall spaced from said housing interior walls, an upper portion of said outside wall having a plurality of openings therethrough and a lower portion of said outside wall having thereon a layer of plastic material for providing a sliding surface; an inlet located at an elevated position on said housing and opening through said housing interior walls; an outlet located at a lower position on said housing and opening through said housing interior walls, said outlet being further positioned below said lower portion of said supply chamber outside wall.

4. The device of claim 3, wherein said layer of plastic material further comprises polytetrafluoroethylene.

5. The device of claim 3 or 4, wherein the layer of plastic material is loosely and removably placed on the lower portion of the supply chamber outside wall, and is secured thereto at least at its edge facing said inlet.

6. The device of claim 3 or 4, wherein the supply chamber further comprises a rectilinear lower portion wherein the lower portion of said outside wall comprises a part thereof, said rectilinear lower portion being aligned along a longitudinal axis inclined at between 30° and 60° to the horizontal.

7. The device of claim 1 or 3, wherein said supply chamber is bow-shaped.

8. The device of claim 1 or 3, wherein said housing further comprises a cylindrical chamber.

9. The device of claim 1 or 3, further comprising an impeller nozzle coupled to said inlet and arranged so as to have a nozzle outlet project into said supply chamber.

10. The device of claim 1 or 3, wherein said axis is inclined at an angle of 45° from the horizontal.

* * * * *